United States Patent [19]

Bentvelzen

[11] 4,338,158

[45] Jul. 6, 1982

[54] PULPING IN THE PRESENCE OF A PROTECTOR

[75] Inventor: Jozef M. Bentvelzen, Sumner, Wash.

[73] Assignee: Weyerhaeuser Company, Tacoma, Wash.

[21] Appl. No.: 274,591

[22] Filed: Jun. 17, 1981

Related U.S. Application Data

[63] Continuation of Ser. No. 764,097, Jan. 31, 1977, abandoned, which is a continuation-in-part of Ser. No. 645,972, Jan. 2, 1976, abandoned.

[51] Int. Cl.[3] ..... D21C 3/00; D21C 9/10

[52] U.S. Cl. ..... 162/37; 162/65; 162/70; 162/76; 162/90

[58] Field of Search ..... 162/37, 40, 65, 70, 162/76, 90

[56] References Cited

U.S. PATENT DOCUMENTS

| | | | |
|---|---|---|---|
| 2,811,518 | 10/1957 | Mitchell et al. | 162/65 X |
| 3,384,533 | 5/1968 | Robert et al. | 162/65 |
| 3,652,386 | 3/1972 | Noreus et al. | 162/65 |
| 3,652,388 | 3/1972 | Croon et al. | 162/65 |
| 3,657,065 | 4/1972 | Smith et al. | 162/65 |
| 3,660,225 | 5/1972 | Verreyne et al. | 162/65 X |
| 3,691,008 | 9/1972 | Worster et al. | 162/65 X |
| 3,701,712 | 10/1972 | Samuelson et al. | 162/65 |
| 3,716,447 | 2/1973 | Aung et al. | 162/65 |
| 3,716,448 | 2/1973 | Roymoulik | 162/65 |
| 3,736,224 | 5/1973 | Grayson et al. | 162/65 |
| 3,740,310 | 6/1973 | Smith et al. | 162/65 |
| 3,759,783 | 9/1973 | Samuelson et al. | 162/65 X |
| 3,764,464 | 10/1973 | Samuelson | 162/65 |
| 3,769,152 | 10/1973 | Samuelson et al. | 162/65 |
| 3,843,473 | 10/1974 | Samuelson et al. | 162/65 X |
| 3,944,463 | 3/1976 | Samuelson et al. | 162/65 |

FOREIGN PATENT DOCUMENTS

| | | | |
|---|---|---|---|
| 895757 | 3/1972 | Canada | 162/65 |

OTHER PUBLICATIONS

DeFaye et al, "Magnesium Salts in the Alkaline-Oxygen Degradation of Cellulose", PPMe, 11(7), 11-1974, pp. T394-T397.

Manouchehri et al, "Influence of Catalysts & Inhibitors Upon the Degradation of Carbohydrates During Oxygen Bleaching", Svensk Papperstidaing, Nr. 13, 1973, pp. 486-492.

Gilbert et al, "Mechanism of Magnesium Retardation of Cellulose Degradation During Oxygen Bleaching", TAPPI, 6-1973, 56(6), pp. 95-99.

Casey, Pulp & Paper, vol. I, 1960, p. 457, Gp. 170.

Myburgh et al, "A Continuous Process for Oxygen Bleaching of Pulps", 23rd TAPPI Alkaline Pulping Conference, 1969, pp. 41-1 to 41-25.

Rowlandson, "Continuous Oxygen Bleaching in Commercial Production", TAPPI, 6-1971, vol. 54, No. 6, pp. 962-967.

Rowlandson, "Review of Oxygen Bleaching After 17 Months of Operation", PPMe., 3-1973, vol. 74, No. 3, pp. 74-79.

Myburgh, "Operation of SAPPI's Oxygen Bleaching Plant", 1973 TAPPI Alkaline Pulping Conference, pp. 227-229.

Chang et al, "Delignification by Oxygen & Alkali", 25th TAPPI Alkaline Pulping Conference, pp. 123-131.

Sinkey et al, "The Function of Magnesium Compounds in an Oxygen Alkali Carbohydrate System", Papper Och Fra, No. 5, 1974, pp. 473-486.

*Primary Examiner*—Arthur L. Corbin

[57] ABSTRACT

In a two-stage cellulosic pulping and bleaching system having first-stage pulping using standard pulping chemicals and second-stage bleaching using an alkaline oxygen system, the addition of a protector occurs only in the first stage pulping instead of between the first and second stages or in the second stage bleach. A magnesium compound is normally used as the protector.

4 Claims, No Drawings

PULPING IN THE PRESENCE OF A PROTECTOR

BACKGROUND OF THE INVENTION

Related Applications

This application is a continuation of my copending application Ser. No. 764,097, filed Jan. 31, 1977, now abandoned, which is a continuation-in-part and contains subject matter disclosed in part in my earlier copending application Ser. No. 645,972 filed Jan. 2, 1976, entitled "Protectors in Oxygen Pulping and Bleaching", now abandoned.

FIELD OF THE INVENTION

The pulping of wood chips and bleaching of the resultant fibers.

Description of the Prior Art

Historically the treatment of wood chips to form a white fiber has been divided into two processes, pulping and bleaching. Recently, the distinction between these processes has become blurred. To provide a background for this invention, the two processes will be defined and distinguished. The present definitions are based upon the definitions provided in a number of pulping and bleaching textbooks and monographs.

Pulping is the changing of wood chips or other wood particulate matter to fibrous form. Chemical pulping includes partial removal of the coloring matter, such as lignin, associated with the wood.

Bleaching is the treatment of cellulosic fibers with chemicals to remove or alter the coloring matter associated with the fibers to allow the fiber to reflect white light more truly.

It has been known that pulp manufactured by the use of oxygen and the paper formed from such pulp had poor strength qualities in comparison to pulps formed by other processes. It has been proposed in a number of patents and articles to overcome the strength problems by the use of a protector or inhibitor which would prevent a harsh reaction between the oxygen and the cellulosic material. These protectors have usually taken the form of some type of magnesium compound, although other compounds such as barium carbonate, calcium carbonate, or zinc carbonate have been mentioned. Magnesium compounds noted as usable as a protector have included magnesium carbonate, magnesium oxide, magnesium hydroxide, magnesium silicate, magnesium chloride, magnesium acetate, and complex magnesium salts.

These protectors have been mixed with the chips in a one-stage pulping system or with the pulp fibers prior to the addition of oxygen when the oxygen is used in the bleaching stage. The protector may be added to the fibers between the pulping and bleaching stage, combined with the bleach stage cooking liquor prior to its addition to the stage, or added to the fibers in the bleach stage. In a one-stage pulping system they would be added with the cooking liquor or to the cooking liquor. However, one one-stage pulping patent, Worster et al, Canadian Pat. No. 895,757, impregnates the chips with the protector prior to cooking.

A number of patents disclose various types of protectors and their addition. These are Mitchell et al, U.S. Pat. No. 2,811,518, issued Oct. 29, 1957; Robert et al, U.S. Pat. No. 3,384,533, issued May 21, 1968; Noreus et al, U.S. Pat. No. 3,652,386, and Croon et al, U.S. Pat. No. 3,652,388, both issued Mar. 28, 1972; Smith et al, U.S. Pat. No. 3,657,065, issued Apr. 18, 1972; Verreyne et al, U.S. Pat. No. 3,600,225, issued May 2, 1972; Worster et al, U.S. Pat. No. 3,691,008, issued May 2, 1972; Samuelson et al, U.S. Pat. No. 3,701,712, issued Oct. 31, 1972; Aung et al, U.S. Pat. No. 3,716,447 and Roymoulik, U.S. Pat. No. 3,716,448, both issued Feb. 13, 1973; Grayson et al, U.S. Pat. No. 3,736,224, issued May 29, 1973; Smith et al, U.S. Pat. No. 3,740,310, issued June 19, 1973; Samuelson et al, U.S. Pat. No. 3,759,783, issued Sept. 18, 1973; and Samuelson et al, U.S. Pat. No. 3,769,152, issued Oct. 30, 1973.

In addition to these patents, there are four articles describing the South African Pulp and Paper oxygen bleach installation at Enstra and its prototype at Billeruds A.B. which use a magnesium protector. These are Myburgh et al, "A Continuous Process for Oxygen Bleaching of Pulps," paper presented to the 23rd TAPPI Alkaline Pulping Conference, 1969, pp. 41-1 to 41-25; Rowlandson, "Continuous Oxygen Bleaching in Commercial Production," TAPPI, June 1971, Vol. 54, No. 6, pp. 962–967; Rowlandson, "Review of Oxygen Bleaching after 17 Months of Operation," *Pulp and Paper Magazine of Canada,* March 1973, Vol. 73, No. 3, pp. 74–79; and Myburgh, "Operation of SAPPI's Oxygen Bleaching Plant," paper presented at 1973 TAPPI Alkaline Pulping Conference. There are also Chang et al, "Delignification of Oxygen and Alkali," a paper presented at the 25th TAPPI Alkaline Pulping Conference, pp. 123–131; and Sinkey et al, "The Function of Magnesium Compounds in an Oxygen Alkali Carbohydrate System" Papper Och Fra No. 5, 1974, pp. 473–486, which is based on the Sinkey Doctoral Dissertation at the Institute of Paper Chemistry, Appleton, Wisconsin, June 1973, 113 pages.

Two of the above patents assigned to Mo och Domsjo Aktiebolag, Samuelson et al, U.S. Pat. No. 3,769,152 and Noreus, U.S. Pat. No. 3,652,386, indicate that the magnesium protector may be furnished by using the waste pulping liquor from unbleached pulps produced by the cooking of wood with magnesium sulfide or magnesium sulfite. In addition, a third patent to the same assignee, Samuelson et al, U.S. Pat. No. 3,701,712, indicates that unbleached pulps produced by digestion of wood by magnesium bisulfite or magnesium sulfite usually contain enough magnesium ion so that no addition of magnesium compound need be made in the oxygen state. These statements will be found in Lines 61–69 in Col. 3 of the Noreus et al patent, Lines 53–62 in Col. 9 of the first-noted Samuelson et al patent, and Lines 38–47 in Col. 5 of the second-noted Samuelson et al patent.

BRIEF SUMMARY OF THE INVENTION

It occurred to the inventor that large excesses of relatively expensive magnesium compounds were being added to the fibers in the bleach stage in order to obtain uniform distribution of the protector throughout the fibers. However, this uniform distribution of the protector throughout the bleach stage treatment is difficult.

The comment by Samuelson et al that a protector would not be needed for pulp from a magnesium-base process is not too helpful because there are few such mills and the pulp from magnesium-based mills do not have general application. Thus, the use of a first-stage magnesium-base pulp would not normally be available.

The inventor decided that it might be possible to reduce the amount of protector being used, to obtain uniform distribution of protector throughout the fibers in the oxygen bleach stage and to obtain the advantages noted for a magnesium bisulfite first-stage cook, by the addition of a small amount of protector to the pulp cook. This would place the protector chemical permanently within the fiber during the bleach stage and provide the desired results.

DETAILED DESCRIPTION OF THE PREFERRED EMBODIMENT

The present invention is used in a system having a chemical pulping stage followed by an alkaline oxygen bleaching stage.

The pulping stage will use a standard pulping chemical-sulfite, modified sulfite, soda or sulfate. Neither magnesium-base pulping processes nor oxygen pulping processes form part of this invention. As stated earlier, the purpose of this invention is to obtain the benefits of the magnesium-base pumping process and apply it to oxygen bleaching without having the limitations of the magnesium-base process. The limitations associated with the use of oxygen with wood chips and the poor quality of the resultant product do not suggest the use of oxygen in the pulping stage. Consequently, the standardly used chemical pulping processes are required for the first stage. The specific conditions of these processes are well known.

The next stage is a standard alkali oxygen bleaching stage in which the fibers are treated with an alkali, usually sodium hydroxide, in the presence of an oxygen overpressure. Typical conditions for this bleaching stage are noted in the patents listed above.

The purpose of this invention is to obtain uniform dispersion of the protector or catalyst chemical, while using less of that chemical, by applying it to the wood chips in the pulping stage rather than in the bleaching stage. Typical protector or catalyst chemicals are also specified in the patents listed above. The preferred protector chemicals are the magnesium chemicals such as magnesium oxide, magnesium carbonate, magnesium hydroxide, and complex magnesium salts. The protector chemical in the amount of 0.01–2% based on the oven dry weight of the wood would be added to the first pulping stage and be incorporated into the fibers during that stage.

Following the pulping stage, the fibers would be separated from the cooking liquor. The excess protector chemical will leave the process with the cooking liquor and be treaed with the cooking liquor to reclaim the protector chemical for reuse.

The treated fibers containing the protector chemical would then be carried to the alkali oxygen bleaching stage and treated in a manner conventional for alkali oxygen bleaching systems as described above.

In this way, less protector chemical would be used and would be dispersed more evenly throughout the fibers.

I claim:

1. A wood pulping and bleaching process comprising a pulping stage, in which wood chips are changed to wood pulp fibers and coloring matter associated with said fibers is partially removed, using wood pulping chemicals other than magnesium-based chemicals and other than oxygen, and a bleaching stage, in which said wood pulp fibers are caused to reflect with light more truly, using oxygen as a bleaching chemical, the improvement comprising adding a protector chemical in the amount of 0.01 to 2% based on the oven dry weight of the wood to said pulping stage only.

2. The process of claim 1 in which said protector chemical is a magnesium compound.

3. The process of claim 2 in which said magnesium compound is selected from the group consisting of magnesium carbonate, magnesium oxide, magnesium hydroxide, and a complex magnesium salt.

4. The process of claim 1 in which said protector chemical is recovered for reuse.

* * * * *